United States Patent [19]

Keller

[11] 4,346,486

[45] Aug. 31, 1982

[54] TRANQUILIZING BED

[76] Inventor: Dorothy V. Keller, 1767 Belvedere Rd., Port Deposit, Md. 21904

[21] Appl. No.: 68,917

[22] Filed: Aug. 23, 1979

[51] Int. Cl.[3] ..... A61G 7/06; A47D 9/02; A47C 21/04

[52] U.S. Cl. ..... 5/447; 5/109; 5/443; 5/453; 5/462

[58] Field of Search ..... 5/446, 447, 435, 453, 5/454, 461, 462, 468, 469, 513, 81 R, 424, 109, 108, 444; 128/33

[56] References Cited

U.S. PATENT DOCUMENTS

| | | | |
|---|---|---|---|
| 2,948,334 | 8/1960 | Goldstein | 5/468 |
| 3,165,759 | 1/1965 | O'Daniell | 5/93 |
| 3,235,891 | 2/1966 | Chade et al. | 5/109 |
| 3,378,861 | 4/1968 | Louseberg | 5/444 |
| 3,398,971 | 8/1968 | Seidel | 5/62 |
| 3,529,311 | 9/1970 | Crawford | 5/109 |
| 3,595,223 | 7/1971 | Castagna | 5/453 |
| 3,633,222 | 1/1972 | Greenfield | 4/185 |
| 4,048,684 | 9/1977 | Korner et al. | 5/453 |
| 4,141,096 | 2/1979 | Hale et al. | 5/108 |
| 4,157,088 | 6/1979 | Gracey | 128/33 |

FOREIGN PATENT DOCUMENTS

| | | | |
|---|---|---|---|
| 903336 | 8/1962 | United Kingdom | 5/449 |

*Primary Examiner*—Alexander Grosz
*Attorney, Agent, or Firm*—Frank W. Lane

[57] ABSTRACT

A mattress, adapted to benefit an occupant in the prone position, having a convexity in the head and torso support area, means for producing a rising and falling motion of the convex support surface, and a sound projecting means located within the convexity and connected with a record player. The surface of the convexity may be "laterally ventilating." The means for causing the rising and falling motion may be fluid dynamic devices driven by motorized reciprocating mechanism or it may be fully mechanical. The leg support surfaces are at least in part lower than the convex support surface and may be separated by a narrow elevation positioned to act as a stop or seat to prevent the occupant from slipping from the convexity. The object is to provide an atmosphere of healthful tranquility for the occupant. It is particularly advantageous for use with a young infant or a mental patient.

4 Claims, 4 Drawing Figures

TRANQUILIZING BED

BRIEF SUMMARY OF THE INVENTION

This invention pertains to a bed; more particularly it deals with a mattress having tranquilizing and calming influences on its occupant. It is constructed basically of the customary soft, resilient materials and may be sized for use with an infant, child or grown person. Its upper surface is designated as the support surface, part of which is the head and torso support surface and another for the support of the legs. The mattress is improved by the incorporation of at least one of the following comforting or tranquilizing features designed to benefit the occupant in the prone position.

A. A head and chest support surface having a convexity which allows the head to assume a slightly forward position.

B. A laterally ventilating (hereinafter defined) upper surface, at least at the head and chest support area, to avoid blockage of the breath.

C. A device, herein called a movable support means, located under the head and torso support surface serving to cause a small, rhythmic rising and falling motion of said surface.

D. A driving means connected to the movable support means whereby the rising and falling motion is initiated.

E. Connecting means between the driving means and the movable support means.

F. A device for projecting sound from within the mattress to the vicinity of the occupant's head.

G. Leg support surfaces somewhat lower than the head and torso support surface.

H. A narrow elevation at the longitudinal centerline of the mattress adjacent to the torso support surface and between the leg support surfaces to act as a seat or stop preventing the occupant from slipping from the convex support area.

I. Means for longitudinally adjusting the position of the narrow elevation.

J. A footrest having a substantially vertical surface facing toward the occupant and so placed at the end of the leg support surfaces as to be contacted by the occupant's feet.

K. Means for supplying controlled warmth to the support surface.

L. Means for adjusting the height of the convex support surface capable of lowering said surface to the general level of the upper surface of the mattress.

BRIEF DESCRIPTION OF THE DRAWINGS

FIG. 1 is a longitudinal centerline vertical sectional view showing the following features.

Figure 1:
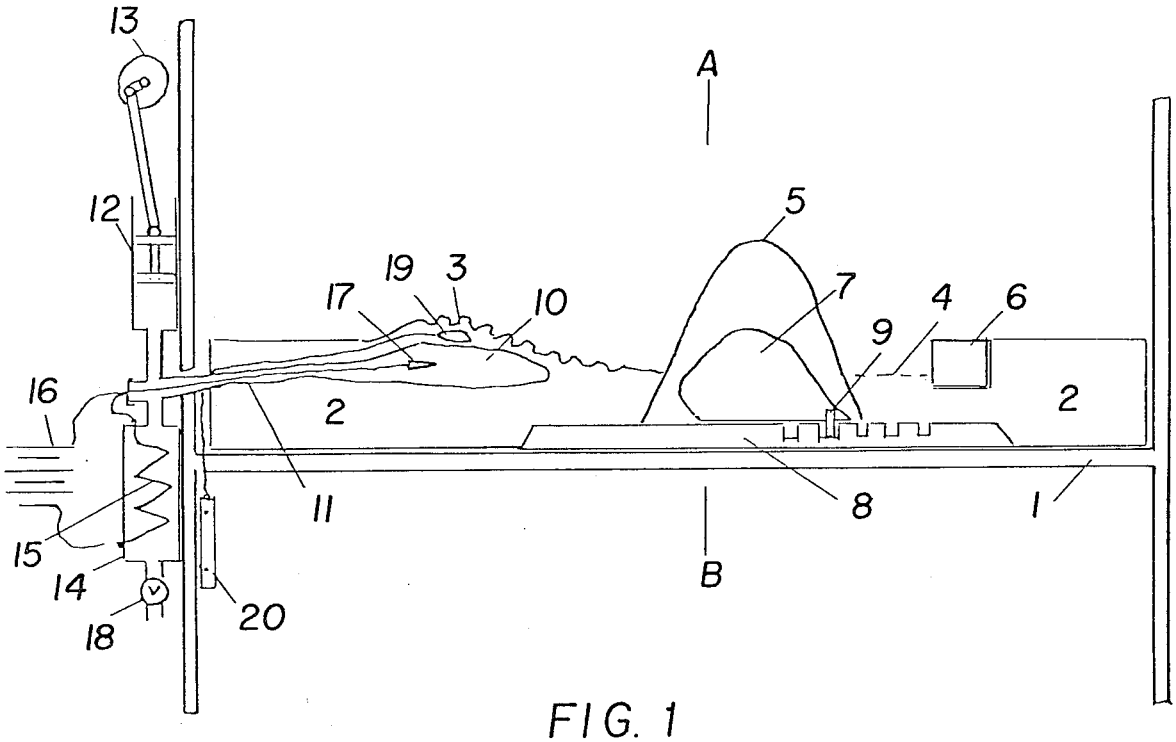
FIG. 1 is a longitudinal, centerline vertical sectional view showing a first embodiment of the invention.

1. The frame of a crib supporting the mattress.
2. The mattress
3. The convex head and torso support having the corrugated or ribbed "laterally ventilating" surface.

4. The support surface for the legs. The dotted line is not on the centerline but is on either side thereof showing separate recessed surfaces for the legs.
5. A narrow resilient elevation at the centerline acting as a stop or seat for the occupant.
6. A cross-member acting as a foot rest.
7. A relatively rigid core in the elevation 5 adapted for sliding on bar 8 to adjust occupant's position.
8. A bar or rail fixed longitudinally near the bottom of the mattress for holding core 7 at various distances from the torso support surface. Grooves are provided on either side (FIG. 2).
9. A projection from the bottom of 7 adapted to fit into the notches in bar 8.
10. A flexible container, for a fluid, in this case a liquid, imbedded in the mattress and in open communication via tube 11 with a pulsating means 12 and heating means 14.
11. A connecting tube for the liquid.
12. A cylinder with a piston for producing a pulsating motion in the liquid system thereby causing the rising and falling motion of the convex surface 3.
13. A motor driven crank to operate the piston.
14. A chamber, in communication with container 10, containing a heating element 15.
15. A heating element powered by battery 16.
16. A source of energy, for warming the liquid depicted here as a battery.
17. A thermostat, connected in series with battery 16 and element 15 to interrupt the current to the heater at a pre-determined temperature near body temperature.
18. A valve for draining and adjusting the amount of liquid in the system.
19. A speaker for projecting sound to the occupant.
20. A record player, eg a continuous tape player to activate speaker 19.

Figure 2:
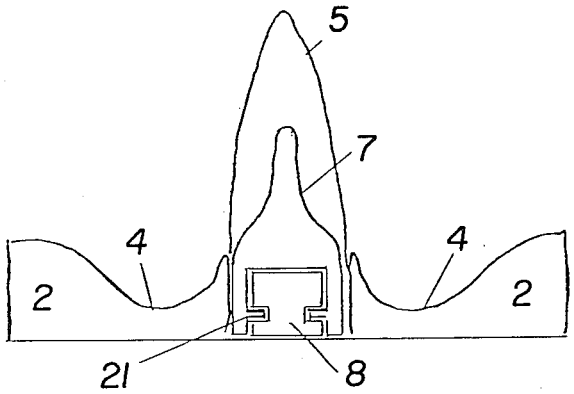
FIG. 2 is a vertical cross-sectional view of the mattress of the first embodiment of the invention, taken at plane A-B of FIG. 1.

FIG. 2 is a vertical cross-sectional view of the mattress FIG. 1 taken at plane A—B.

2. The mattress
4. The leg support surfaces which provide trough-like depressions for receiving the legs.
5. The centerline elevation.
7. The core of the elevation.
8. The guide fixed longitudinally at the base of the mattress with a groove in each side to receive pins 21.
21. Pins fixed in the skirt of the core piece and adapted to slide in the grooved rail or guide 8.

Figure 3:
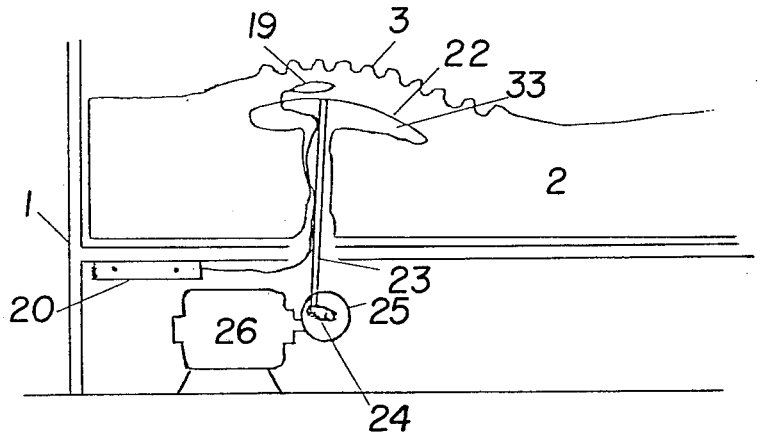
FIG. 3 is a longitudinal, centerline vertical sectional view showing a second embodiment of the invention.

FIG. 3 shows a mechanical method for producing the rising and falling motion of the head and torso support surface.

1. The supporting crib frame.
2. The mattress
3. The convex support surface.
19. The speaker.
20. The record player.
22. A movable support means comprising a plate located within the mattress and conforming approximately in shape to the desired curvature of the support surface above it.
23. A rod articulating with plate 22 and connected to crank 24.
24. A crank operating at rather slow speeds by reducing gear 25 and motor 26.
25. A reducing gear train.
26. A variable speed motor.

33. An opening or slit in the mattress to accommodate the motion of 22.

Figure 4:
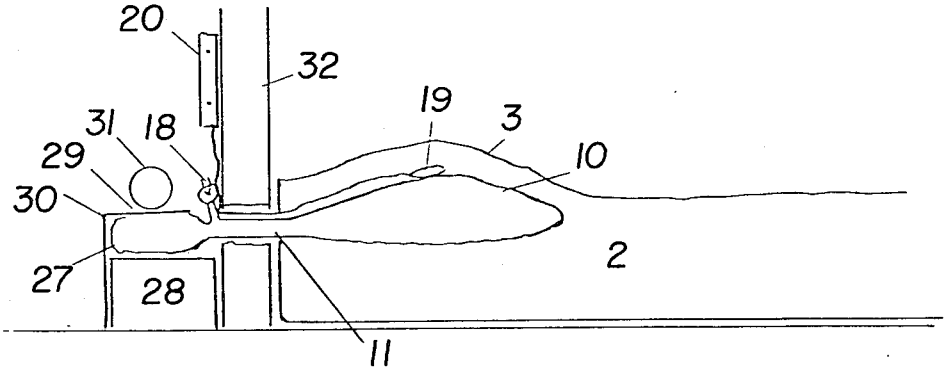
FIG. 4 is a longitudinal, centerline vertical sectional view showing a third embodiment of the invention.

FIG. 4 shows a mattress of simpler design well adapted for use by an adult. It is positioned on the floor near a wall.

2. The mattress.
3. The convex head and chest support having a circular mound shape.
10. A flexible, preferably elastic, container for a fluid in this case a gas, to be used in this pneumatic variation. It is in open communication via tube 11 with its companion container 27.
11. The communicating tube.
18. A valve for adjusting pressure in the system.
19. The sound producing speaker wired to player 20.
20. The record player.
27. A second flexible container in communication with container 10.
28. A supporting base for container 27.
29. A substantially rigid plate hinged at 30 which provides alternate pressure and release to container 27 when activated by cam 31.
30. A pivoting device such as a hinge.
31. A cam providing reciprocating motion to plate 29 driven by powered means at speeds in the range of around 6 to 20 rpm.
32. A wall of the room.

DETAILED DESCRIPTION

This invention pertains to beds for occupancy by humans. The improvements claimed herein are related to the mattress part of the bed which may be of correct size for the intended occupant. In the case of an infant the mattress is preferably fitted to a protective container such as a crib. For the larger sizes which are primarily intended for use with mental patients, the containment is not usually wanted and the mattress is placed on the floor or on a simple box-like elevation. The mattress is constructed of the usual materials including stuffing and the like but a foamed plastic material is preferred since the shape and degree of rigidity can be more easily controlled. For ease in describing this invention, specific areas of the upper surface of the mattress are designated as the head, chest, torso, and leg support surfaces. In general the mattress with its herein described improvements is designed for the benefit of occupants lying in the prone position i.e. chest downward.

One aspect of the invention is the convexity in the head and torso support surface. The curvature, extent and height of this convexity may vary to suit the size and needs of the occupant. Its purpose is to provide a head and neck position in which the head is in a slightly forward position even though the face may be turned toward the side. To this end, the occupant's position is adjusted to bring the neck near the apex of the convexity. Such a position is believed to improve the passage of air during breathing. It has been reported that some infants encounter difficult breathing when lying on a flat surface. Furthermore the convex support simulates the contour of a mother's body as a child is held to or is lying on the mother's shoulder and breast. This and other aspects of the invention serve to provide a comforting and safe environment for the occupant thereby freeing the mother or attendant for other duties. The curvature of the convexity need not be constant throughout the surface. Thus, it may rise gently from the general plane of the mattress top and soon become convex in the major support area. The degree of convexity may vary in the various parts with the length of the radius of curvature at the apex preferably being in the range of from one eighth to one and one half times the distance from the top of the head to the bottom of the rib cage of the occupant. In the case of an infant the convexity is preferably cylindrical as indicated in FIG. 1. However the apex may be somewhat lower midway between the sides of the mattress to help keep the occupant centered. The apex of the convexity should be placed toward the head end of the mattress so that the other positioning features, eg the center elevation and the foot rest may be set to bring the occupant's neck approximately over it thereby providing the slightly forward tilt of the head. In the case of adults, a circular mound shaped convexity is preferred since it invites the occupant to lie prone with the arms encircling the apex.

Most mattresses have a smooth or even glossy surface or a plastic sheet cover. Such a surface or cover can possibly seal a child's mouth if turned face down, resulting in suffocation. To avoid this the instant mattress may be provided, at least in the head and upper chest support area, with a "laterally ventilating" surface. This term is used here to refer to an uneven or corrugated surface which will provide air passage to the child even though the mouth is against the support. This may be accomplished by providing ridges and or grooves running crosswise, lengthwise or diagonally in the upper surface of the mattress. Nubs or raised figures such as Xs may also be used. In any case the size and shape is chosen so as to not fit snugly in the child's mouth. The size of these surface elevations may vary but preferably range from one quarter to one inch in either horizontal or vertical thickness. Such configurations are readily obtainable during the molding of a foamed plastic mattress. For sanitary reasons the surface of this area, and of the whole mattress, may have a water-proof coating. This coating should be integral with the irregular surface rather than being a loose plastic sheet laid over it. A porous, soft blanket may be laid over the mattress for comfort.

A further improvement is a provision for maintaining a small rising and falling motion of at least a portion of the head and torso support area including the convexity. This is done with a relatively slow action to imitate the breathing of a mother holding an infant. The motion may be accomplished as shown in the figures, by a movable support means capable of undergoing vertical reciprocal motion, operated by a fully mechanical means or by fluid dynamic devices including hydraulic and pneumatic. The movable support means is provided with connecting means to a driving means capable of reciprocating action thereby producing the rising and falling motion of the support surface. In the case of the fluid dynamic systems the connecting means is a tube joining the first container with a second container to which a pulsating action is imparted by the driving means. Various fully mechanical devices such as suggested in FIG. 3 are contemplated wherein 22 is a rigid or nearly rigid plate conforming generally in shape to the support surface above it and installed inside the mattress. The rising and falling motion is obtained by means of rod 23 which is activated by an eccentric or crank 24 driven by a motor 26 through a speed reducing device 25. The speed of the crank may be varied by known means, a good range being from 6 to 20 revolutions per minute. The amplitude of the motion may be varied by adjusting the effective length of the crank. By disconnecting the rod, the convex support surface may be lowered to a substantially flat condition. The amplitude of the motion of the support surface may be quite small, e.g. from one eighth to one inch, and may be adjusted to what seems best for the occupant. In the case of an infant, a one inch movement would seem a likely maximum but should not be considered limiting. The size and shape of the plate may vary to suit the size and shape of the convexity. Thus, it may be square oval, round, or rectangular. For example, a narrow rectangular shape positioned crosswise of the mattress would conform to a small cylindrical convexity.

Fluid systems are illustrated in FIGS. 1 and 4. Examples of fluids contemplated for use are water and air. If conditions indicate the water may contain anti-freeze. The fluid container 10 is inserted in the mattress under the head and chest support area so that, as it expands and contracts under the influence of the incoming and outflowing fluid, the rising and falling motion is obtained. This container is constructed from available material such as rubber or plastic. In any case, it should be flexible and may also be elastic. The size and shape of the container may vary and is chosen to conform to the desired shape of the convexity above it. An opening in the mattress, preferably a slit in the end or side thereof, is provided for installing and removing the container. Open communication with a second fluid container external to the mattress by means of a tube is maintained during normal operation. The external container is where the motion, or reversing flow, of the fluid is generated. It may be a flexible container activated by a squeezing device as shown in FIG. 4. Alternatively, it may be a rigid parallel-walled container, such as a cylinder, fitted with a piston, e.g. a valve-less piston pump, a syringe or the like as shown in FIG. 1. Motor driven cranks, cams and the like may be employed to activate the external container. While water is the preferred fluid as it gives a relatively positive action, a gas e.g. air may be used. Both may be present at the same time in the system. The volume of the second container, or more accurately the displacement volume of the second container, should be chosen in relation to the volume of the first container so that the desired motion of the latter is achieved.

Another feature of this invention is the propagation of sound in the direction of the occupant thereby further contributing to the atmosphere of tranquility. One convenient means of doing this is to install a loud speaker (19 in FIG. 1) under the support surface and connect it to a record player. The intensity of the sound is adjusted to a natural level as measured in the vicinity of the occupant's ears. Small disc-shaped speakers are now available for use under a pillow which are well suited for use here. The composition of the projected sound may vary. The sound of a human heartbeat is considered appropriate for an infant. Other sounds such as soothing music, familiar voice sounds, lullabies, stories, etc. may be selected depending on the individuals response and age.

This invention also may include support surfaces for the legs which are at least in part lower than the torso support surface. For comfort, the supporting surface near the feet may slope upward to give a flexed knee position. In FIG. 1 the support surface is relatively elevated in the head and torso support area and, at about the point where the occupant's hip joints rest, the support surface slopes down to a recessed area generally below the normal top surface of the mattress. This leg support area may be a single depression wide enough and long enough to accommodate leg movements. However, in the presence of the center-line elevation (5 in FIGS. 1 and 2) the recessed leg support area is duplicated on either side of the elevation. In either case the edge portions of the mattress are maintained at the normal level for protection.

Because of the slope and motion of the head and chest support surface there can be a problem of keeping an infant occupant in position. One means of meeting this is to provide the above mentioned relatively narrow elevation at the longitudinal center-line of the mattress placed approximately adjacent to the torso support area. To accommodate the growth of a child, this feature can be fastened to the mattress with provision for adjusting its position along the centerline. Ties, buttoned flaps or zipper-type devices may be used. In a more sophisticated adaptation the center elevation may be provided with a rigid core of wood or plastic (7 in FIGS. 1 and 2) adapted to be adjustably positioned along a guide placed lengthwise at the bottom center of the mattress. The guide bar is provided with side grooves to engage pins in the skirt piece of the core which may be slid along the bar and locked at various distances from the torso support surface by means of a small extension on the underside of the core which engages the notches on the top of the guide bar. To accommodate this feature a center slit is made in the mattress permitting the elevation to be slid along the bar and yet providing close contact between the elevation and the leg support surface thereby protecting the occupant from contact with the core piece or the bar. With this arrangement the elevation may be slid onto the bar from the foot end of the mattress and similarly removed when desired. With the core in place on the bar its position may be adjusted by raising the end away from the guide pins and relocating the core in a position of engagement with another notch where its position is secured by pressure from the occupant.

As a simple alternative or adjunct to the center elevation a footrest may be provided. It is a cross member placed at the lower or foot end of the leg support surface having a substantially vertical surface positioned to firmly contact the occupant's feet. It may be adjustable as to position by being fastened to the mattress with snaps, buttons or zippers etc. When the lowered leg support surface is present the foot rest may comprise a rectangular strip of mattress material laid crosswise at the foot of the leg support area, being a sort of insert for the mattress. Such inserts of varying width may be used, to accommodate the occupant, or several narrow inserts may be used. Even with the center elevation in place, such footrest pieces may be used in pairs, one for each recessed leg support area.

For occasional use a source of heat for the support area may be employed. A heating pad for example could be placed between the container (10 in FIG. 1) and the support surface. However, the use of electrical circuits so near the occupant presents some danger. It is preferable to insert a heating element (15 in FIG. 1) in the fluid system somewhat remote from the occupant and below the first container. Since the warm fluid normally rises, especially under the pumping action of the device, the support area will be warmed. To avoid overheating, a thermostat can be placed in the container below the support surface. In fact, for added safety, another thermostat can be placed just above the heating element. In either case the thermostat or thermostats will be wired in series with the heating element and the power source, the latter being shown as a battery in FIG. 1. The thermostats would be adjusted to maintain a temperature of the support surface at near body temperature or below. Instead of electric heating, a coil of tubing supplied with warm water acting as a heat exchanger may be used for transferring heat to fluid provided adequate thermal control is maintained.

Means for adjusting the height or level of the convexity is provided. In the fluid systems this is accomplished by use of valve 18. These valves are used to either fill or empty the system and can also control the amount of fluid therein. On occasion, it may be desirable to return the support areas substantially to the normal mattress level. This is accomplished by removal of the fluid from such systems and by disconnecting the activating rod in the mechanical systems.

The foregoing description pertains chiefly to the care and health of an infant. Occasionally an infant or young child has been found dead in a crib but the moment of dying has not been observed. This is known as crib death. Suffocation apparently is not the cause. Some have theroized that a weak child, in the silent absence of any stimulation, may simply cease to maintain its vital functions. In view of this it may be that the natural though quiet stimulation provided by this invention can prevent such unfortunate occurrences. With stronger, more active infants the natural sounds and motion provided by this invention tend to be soothing and sleep inducing. In any case, the infant's reaction, particularly when using the center elevation, should be carefully watched until one is certain that the occupant will remain comfortable.

This invention is also useful in caring for adults, particularly mental patients. FIG. 4 shows an adaptation for this purpose. To the observer the mattress exhibits only the unusual convexity. In this case the convexity is preferably a circular mound containing the same devices for producing motion and sound as previously described. A crib or other close enclosure is not thought to be desirable. Since the main objective here is the calm the patient, cages or holding devices are believed to be avoided. The patient, hopefully, will eventually be attracted to the bed and use it to advantage. However, the auxiliary equipment is preferably placed out of reach, e.g. in an adjacent room or closet with the servicing tube and wires passing through a wall near which the mattress is placed, preferably on the floor or on a strong box-like support to bring the mattress to a normal bed level. Such a box-like support may be used to enclose the servicing mechanisms particularly in the case of using mechanical means for producing the rising and falling motion of the convexity. Covering the whole mattress with a soft attractive blanket could avoid unwanted reactions. Different patients probably will react differently with responses, on seeing the new bed, ranging from fear to love. The attendant must therefore carefully observe the patient and approach the situations experimentally with the idea of possibly selecting only certain types for use of the bed.

In using the mattress of this invention in a case, for example, where water is used as the fluid, one would prepare the containing system for filling by first disconnecting the the piston device (FIG. 1) by removing the rod from the crank 13 in FIG. 1. The piston is then removed and water poured into the chamber 12 until the system is filled. The piston is returned to its operating position and reconnected to the crank. The height of the convexity may then be lowered, if too high, by briefly opening valve 18. The centerline elevation 5 is then put in place by raising the end with the projection 9 and sliding it along the guide bar until the seat portion is at such a distance from the convexity that the infant's neck will be at or near the apex of the convexity. The elevation can be further adjusted with the infant in place. A soft, porous blanket may be placed over the mattress. The foot rest 6 is not really needed when using the elevation. The infant is then placed, chest downward, with one leg on either side of the elevation and the face preferably turned to one side. Further adjustments may be made to position the child with its neck near the apex of the convexity. The rising and falling motion (simulated breathing) is started by activating driving means 13 and setting it to about ten revolutions per minute of the crank. The tape player 20 is provided with a tape cassette having the recorded sound, e.g. of a human heartbeat, turned on and the loudness brought to a natural level. The child is then observed for a time until it appears to be content and comfortable after which periodic inspection is made. In case the room is cold the heating element 15 is turned on.

I claim:

1. A mattress designed to comfort and tranquillize an occupant in the prone position having the following features;

a head and chest support surface having a convexity, leg support surfaces somewhat lower than the head and chest support surface, movable support means, located under the head and chest support surface serving to cause a rhythmic rising and falling motion of said surface, a motor driven reciprocating driving means connected to said movable support means, a relatively narrow, removable elevation at the longitudinal centerline of said mattress adjustably mounted between the leg support surfaces on a guide bar placed longitudinally at the bottom of the mattress.

2. The mattress of claim 1 wherein said movable support means comprises a first fluid filled flexible container in open communication with a second fluid filled container located outside the mattress and connected to a motor driven reciprocating device adapted to alternately apply and release pressure to the fluid in said second container thereby causing alternate expansion and contraction of said first fluid filled container.

3. The mattress of claim 2 wherein the fluid in said second fluid filled container is in contact with a thermostatically controlled heating device.

4. The mattress of claim 1 or claim 2 or claim 3 wherein a device for projecting sound is placed in the mattress in the vicinity of the occupant's head and connected to a player located outside the mattress, said player being fitted with a recording of a heart beat.

* * * * *